US005765352A

United States Patent [19]

McRae

[11] Patent Number: 5,765,352

[45] Date of Patent: Jun. 16, 1998

[54] YARN SPLICING DEVICE AND METHOD

[75] Inventor: Daniel P. McRae, Jamestown, N.C.

[73] Assignee: Petree and Stoudt Associates, High Point, N.C.

[21] Appl. No.: 856,481

[22] Filed: May 14, 1997

[51] Int. Cl.[6] ..... D01H 17/00

[52] U.S. Cl. ..... 57/22; 57/23; 57/287

[58] Field of Search ..... 57/22, 23, 287, 57/261

[56] References Cited

U.S. PATENT DOCUMENTS

| | | | |
|---|---|---|---|
| 4,411,128 | 10/1983 | Mima | 57/261 |
| 4,414,798 | 11/1983 | Matsui et al. | 57/261 |
| 4,539,802 | 9/1985 | Bertoli et al. | 57/22 |

FOREIGN PATENT DOCUMENTS

| | | | |
|---|---|---|---|
| 5-78042 | 3/1993 | Japan | 57/22 |
| 5-86532 | 4/1993 | Japan | 57/22 |

*Primary Examiner*—William Stry Jewski

[57] ABSTRACT

A yarn splicing device and method provides for overlapping yarn ends from different spools or packages of yarn to form a smooth, continuous splice. The device allows the operator to place the different yarn ends in a pair of clamps that are separated by a pneumatic commingling jet. After the yarn is clamped into place the yarn ends, which consist of multi-filament yarns, are pneumatically commingled and thereafter the clamps are rotated in opposite directions from the commingling jet to stretch the splice junction to reduce the diameter thereof. Thereafter the clamps release the spliced yarn so it is available for removal and further processing such as texturizing. The splicing method described provides a fast, efficient method which provides for uniform yarn diameter which does not slow or obstruct other yarn processing steps by snagging or breaking at the splice junction.

14 Claims, 5 Drawing Sheets

YARN SPLICING DEVICE AND METHOD

BACKGROUND OF THE INVENTION

1. Field of the Invention The invention herein pertains to the joining or splicing of yarn ends as required in yarn processing such as in the continuous texturing of yarns and in particular pertains to the splicing of multi-filament yarn ends pneumatically.

2. Description of the Prior Art And Objectives of the Invention In order to join yarn ends during yarn processing from different spools or packages such as with multi-filament polymeric yarns, various types of splicing jets have been devised whereby the filaments of the yarn ends are commingled by pulses of air. A current practice in the art provides for overlapping of two multi-filament yarns which are then manually drawn and spliced together with a standard air splicer. This joining or splicing allows the yarn-processing machinery operators to continuously operate equipment without equipment downtime during the substitution of new yarn packages. The splicing of multi-filament yarn ends has presented a problem in the past since the junction or splice has an increased diameter over the unspliced yarn. This larger diameter splice will abrade certain eyelets, rollers and the like through which it must pass during processing and because of its greater size can cause instability in the yarn which results in yarn breakage, undesirable equipment stoppage and waste.

Splicing techniques in the past have attempted to lessen or reduce the splice diameter and one technique that has been attempted in the past stretches the yarn ends to reduce the yarn diameter before splicing occurs, such as by manually manipulating the ends. This technique is slow, cumbersome and is not precise, oftentimes with uniformity problems which affect subsequent processing of the yarn.

Thus, with the problems and disadvantages associated with multi-filament yarn splicing, the present invention was conceived and one of its objectives is to provide a method for splicing yarn ends which is accurate, uniform and which provide a durable junction.

It is still another objective of the present invention to provide a device and method for splicing multi-filament yarn ends which is easy to learn and convenient for those of relatively little skill or experience.

It is still another objective of the present invention to provide a yarn splicing device having a pair of pneumatically operated yarn clamps and a commingling jet therebetween for splicing overlapping yarn ends;

It is a further objective of the present invention to provide a yarn splicing device and method whereby the yarn junction is stretched after splicing to reduce its diameter.

It is a further objective of the present invention to provide a yarn splicing device which will operate in a fast, reliable manner to provide a consistent, precise splice with minimum manual effort.

Various other objectives and advantages of the present invention will become apparent to those skilled in the art as a more detailed description is set forth below.

SUMMARY OF THE INVENTION

The aforesaid and other objectives are realized by providing a yarn splicing device and method of operating the same whereby two ends of multi-filament yarn such as 70-denier 34 filament polyester yarn from different yarn packages can be overlapped in parallel alignment by placing each opposing end in a pair of pneumatic yarn clamps which are spaced apart. Positioned between the clamps is a pneumatic operated commingling jet which is axially aligned for receiving the two yarn ends placed within the clamps. The clamps and commingling jet are operated pneumatically by a trigger valve and once the yarn ends are so placed, the trigger is manually pulled, which closes both clamps to secure the overlapping yarn ends. Next, without further manual effort, a burst of air is emitted from the commingling jet which forms a yarn splice or junction having a length of approximately 12 mm. Next, an air cylinder activates which extends a clamp slide, causing the clamps to rotate in opposite directions away from the commingling jet to stretch the yarn junction contained therebetween. The clamps then rotate back to their original or rest position and by manually releasing the trigger each of the clamps open so the spliced yarn can then be manually lifted from the device. A smooth, uniform junction is created which has been reduced in diameter to the approximate original yarn diameter.

This device and method are particularly helpful for joining yarn packages such as a trailing end of a running yarn package to the lead end of a new yarn package as are used on yarn texturing and other textile equipment.

DESCRIPTION OF THE PREFERRED EMBODIMENT AND OPERATION OF THE INVENTION

Figure 1:
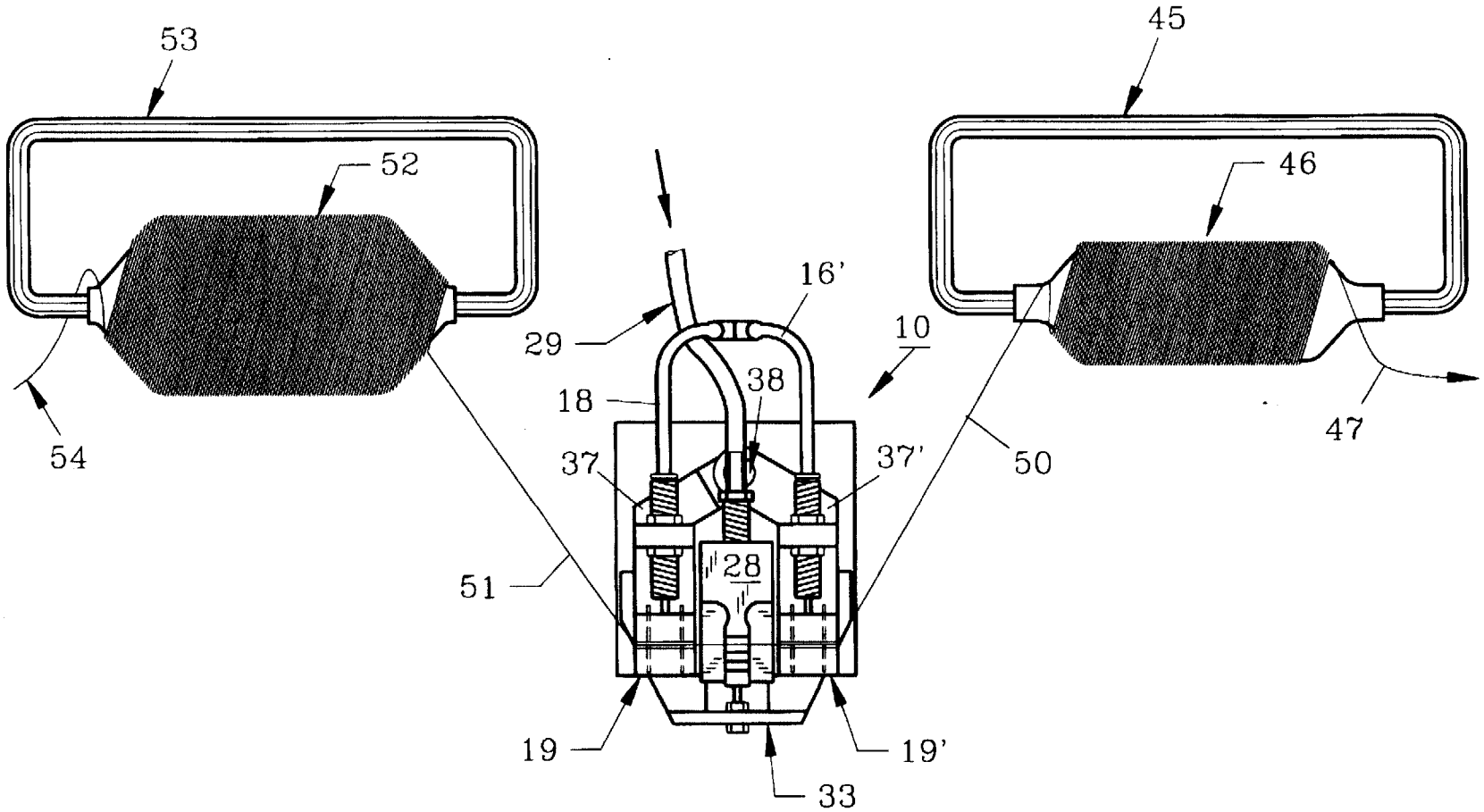
FIG. 1 illustrates in schematic fashion the preferred yarn splicing device of the invention positioned between a running yarn package and a new yarn package.
Figure 5:
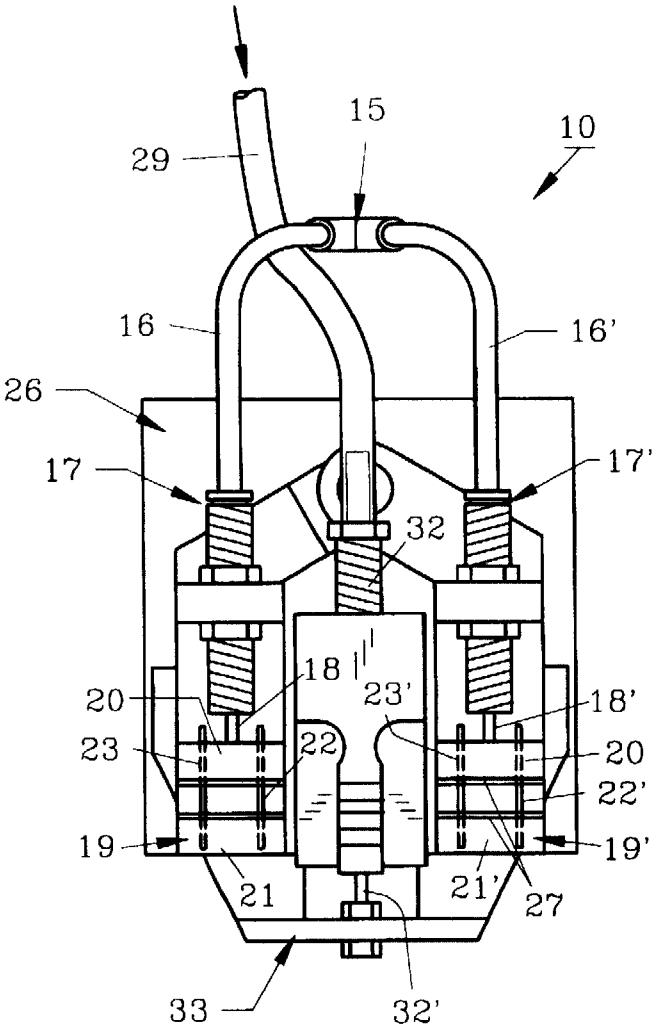
FIG. 5 pictures an enlarged top view of the yarn splicing device as shown in FIG. 1 schematically without yarn.
Figure 2:
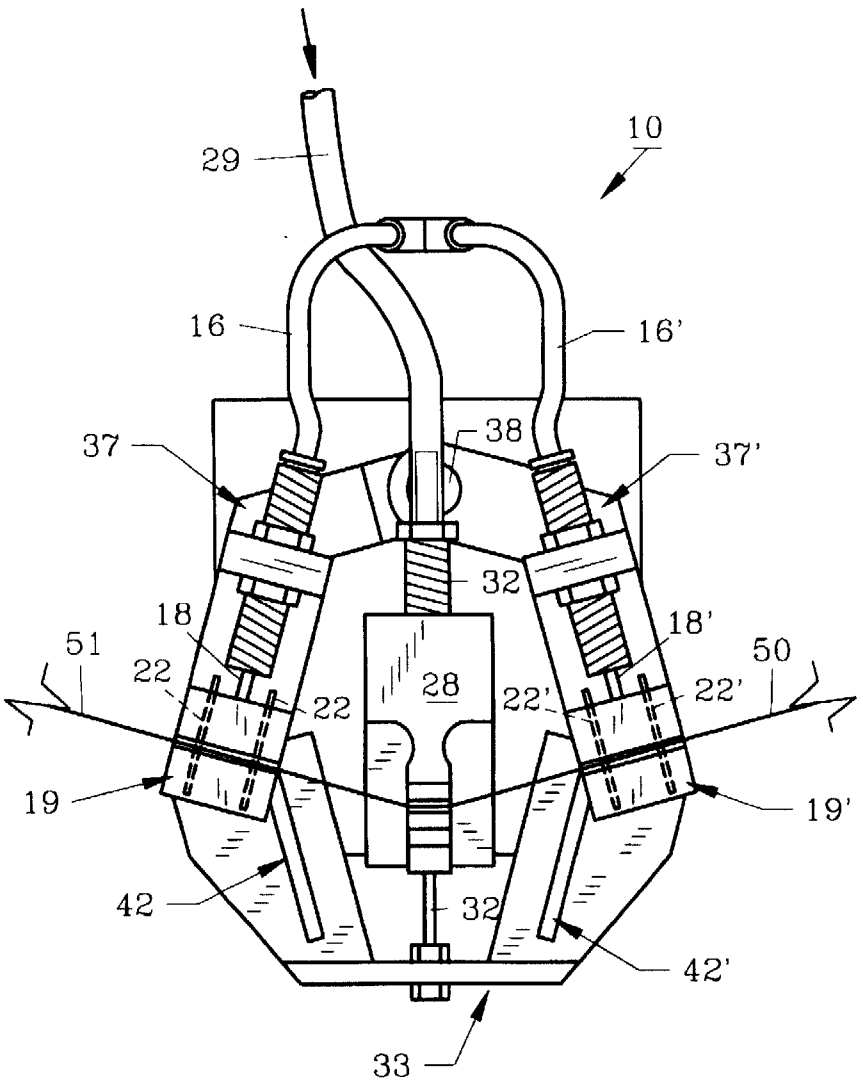
FIG. 2 shows the splicing device as shown in FIG. 1 enlarged but with the yarn clamps rotated as when stretching the yarn.
Figure 4:
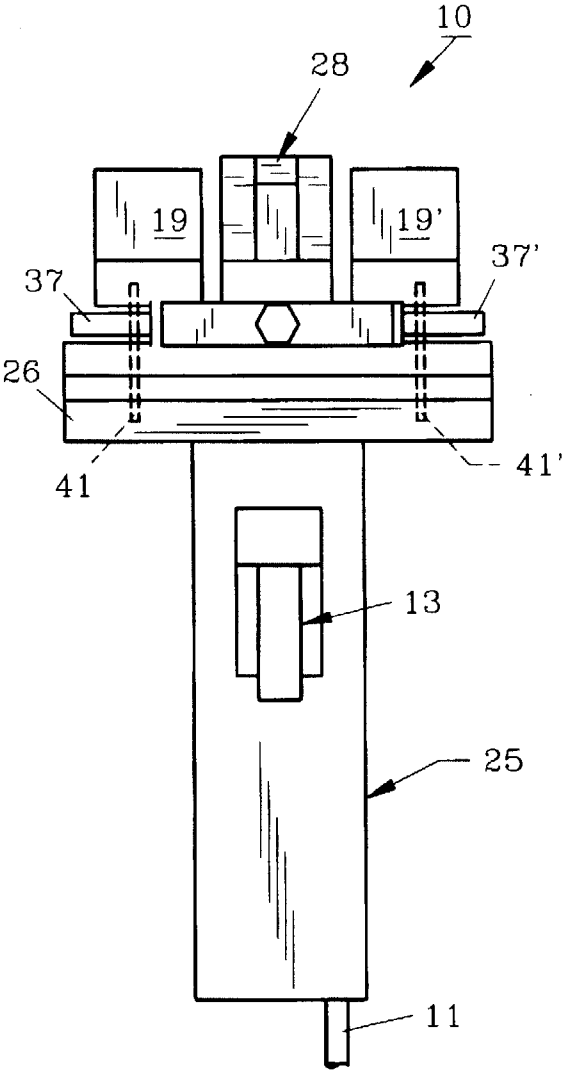
FIG. 4 features a front view of the yarn splicing device as shown in FIG. 3.
Figure 3:
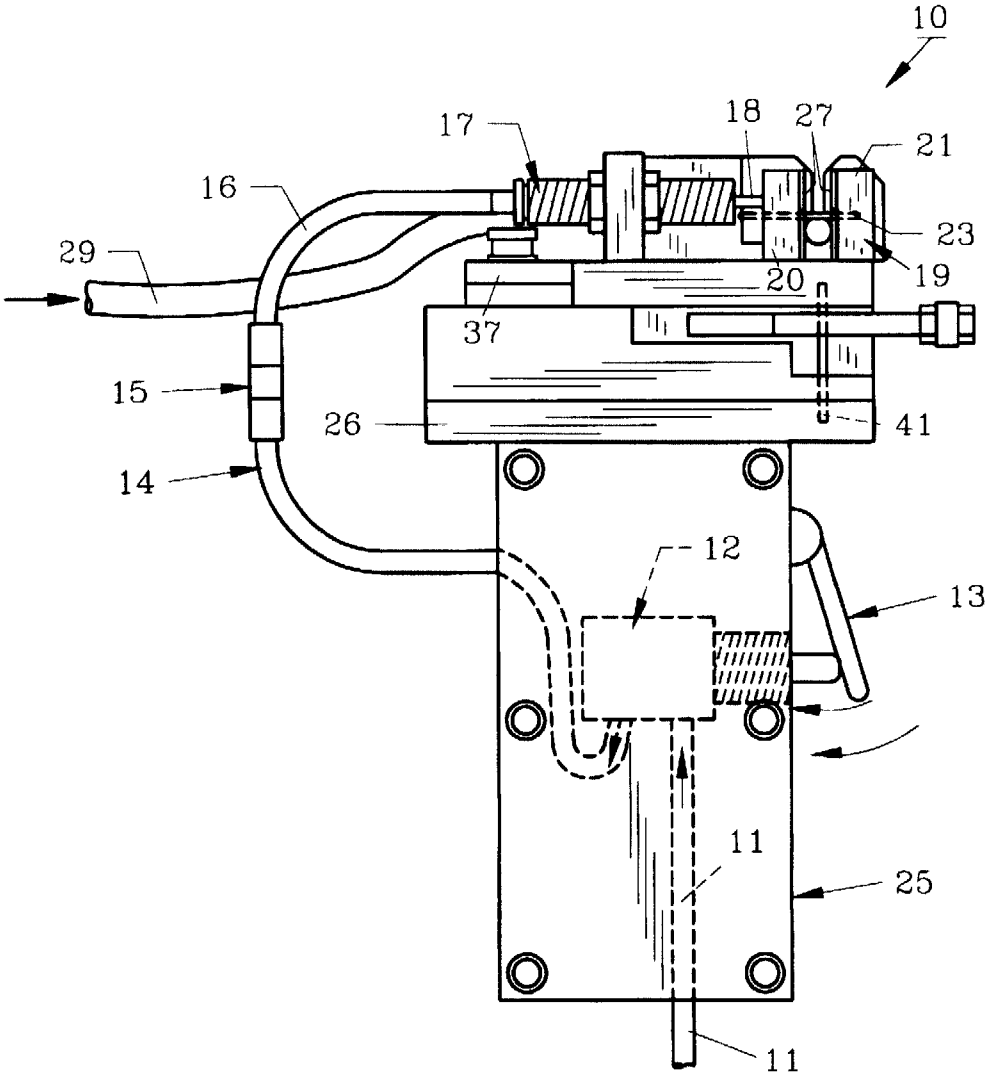
FIG. 3 demonstrates an enlarged elevational view of the yarn splicing device as seen in FIG. 1 but without any yarn.

For a better understanding of the invention and its operation, turning now to the drawings, preferred yarn splicing device 10 is shown in FIGS. 1, 2, 3, 4, 5 and the pneumatic components schematically in FIG. 10. In FIG. 1, air from a conventional source such as an air compressor (not shown) at 80 psi, is directed through supply line 11 as seen in FIGS. 2 and 3, where it passes through a conventional three-way pneumatic trigger valve 12, which is manually operated by trigger 13. Air passing through valve 12 exits through conduit 14 and enters Y-coupling 15 which supplies air to pneumatic cylinders 17, 17' (FIG. 5) as manufactured by Scott Equipment Company (Model Nos. 14N-1A06-B05) through cylinder supply conduits 16, 16'. Cylinder rods 18, 18' drive yarn clamps 19, 19' to a closed position causing rear jaws 20, 20' to slide towards rigidly affixed front jaws, 19, 19' along jaw rails 22, 22', 23, 23' as seen in FIGS. 2 and 5. As seen in FIGS. 3 and 4, trigger valve 12 is contained within handle 25 which, in turn, is attached to planar splicing platform 26.

In order to tenaciously hold yarn ends 50, 51 (FIG. 6) in clamps 19, 19', a resilient, friction-producing surface 27, preferably made from a soft polyurethane is affixed to the inner faces of clamp jaws 20, 21, 20', 21' as seen in FIG. 3. Surfaces 27, hold the yarn tightly and prevent it from slipping during clamp rotation as will be explained in more detail below.

Yarn clamps 19, 19' rotate in opposite, arcuate directions while securely clamping yarn ends, such as yarn ends 50, 51 shown in FIGS. 1 and 2 after commingling of yarn ends 50, 51. This rotation stretches the intermingled yarn ends and reduces the commingled junction diameter as shown in FIGS. 6–8, to the approximate original yarn 47 diameter.

As further seen in FIG. 1, yarn package 46 is shown with yarn 47 being directed for processing to a texturing machine (not seen) or otherwise and affixed to yarn package support 45. Trailing end 50 of yarn package 46 is positioned in yarn splicing device 10, within clamps 19, 19' and commingling jet 28. Leading end 51 of similar yarn package 52, which may be, for example, a raw package of 70-denier 34 filament polyester yarn, is also placed in contiguous overlapping relation with yarn end 50 in splicing device 10. Yarn package 52 is idle and is contained within yarn package support 53. Trailing end 54 of yarn package 52 is shown unattached and free in FIG. 1.

Figure 6:
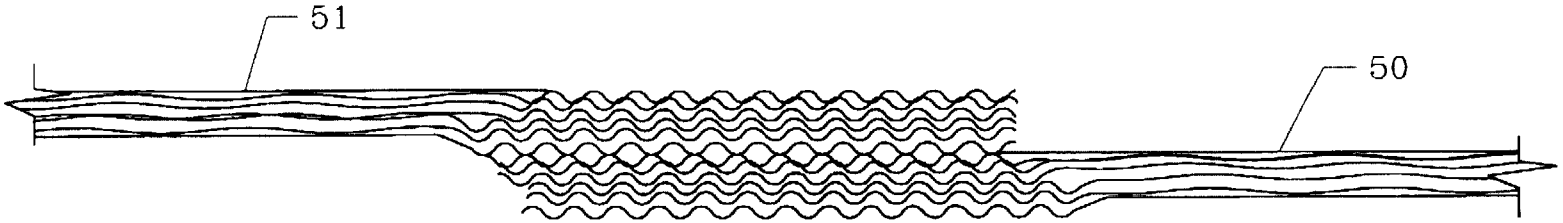
FIG. 6 depicts a pair of enlarged, multi-filament yarn ends overlapped in parallel fashion before splicing.
Figure 7:
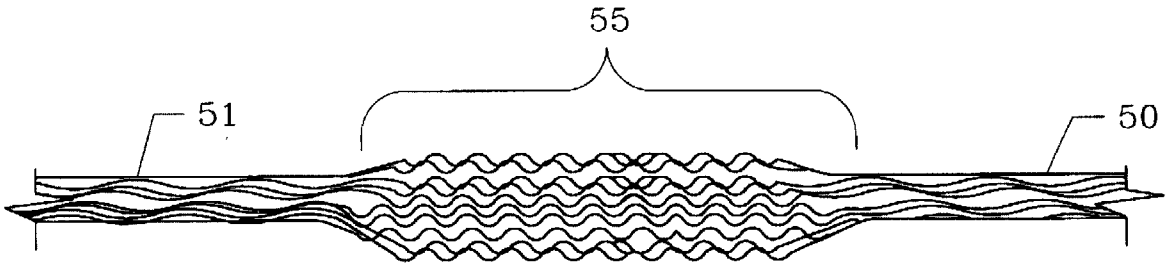
FIG. 7 shows the yarn ends as seen in FIG. 6 after the filaments are commingled.
Figure 8:
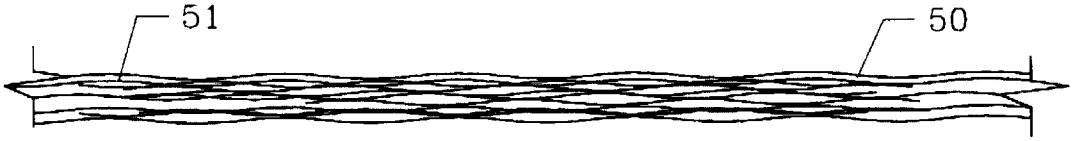
FIG. 8 demonstrates the yarn splice of FIG. 7 after the splice has been stretched.
Figure 9:
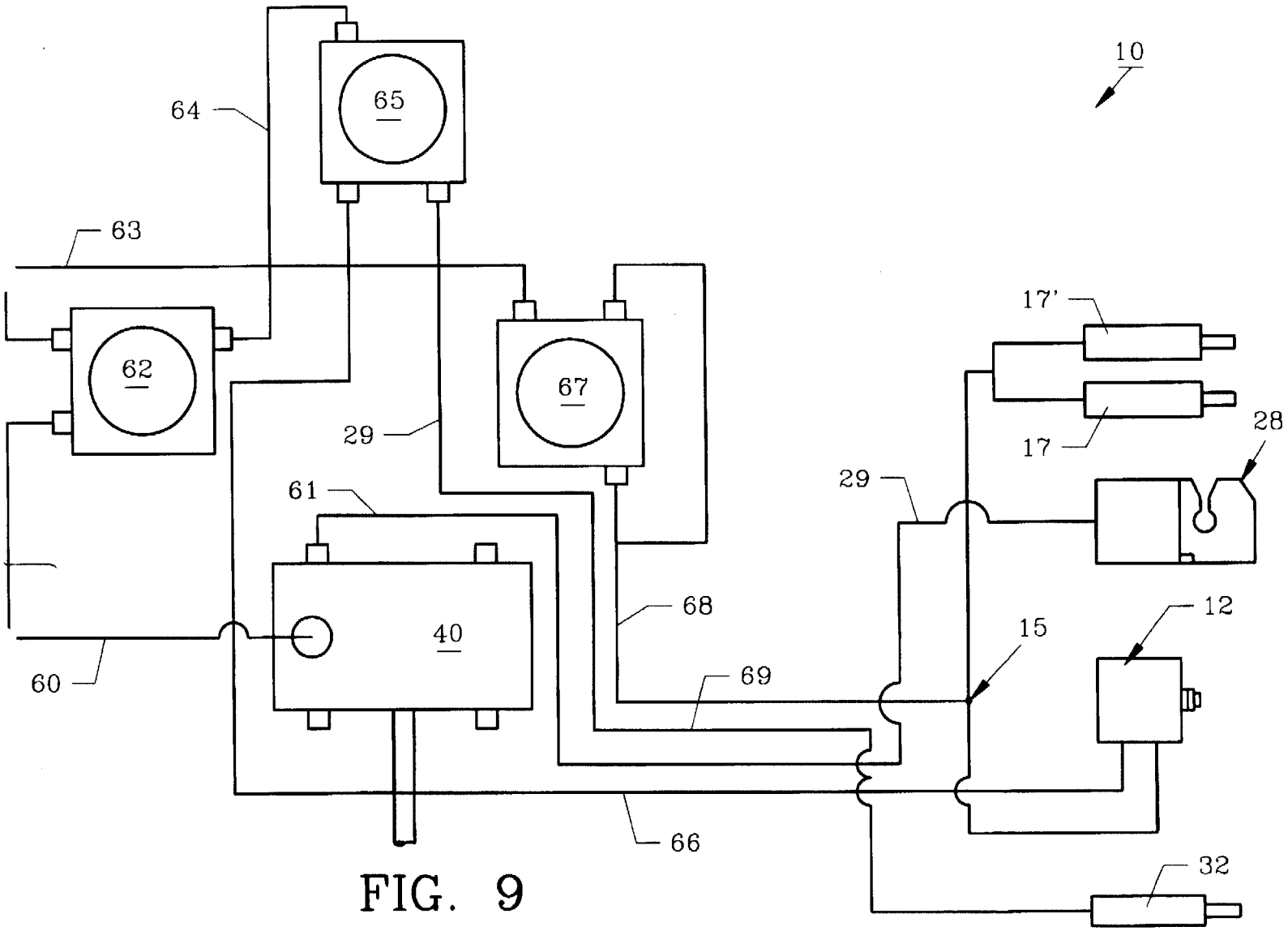
FIG. 9 presents a schematic diagram of the pneumatic components of the yarn splicing device as seen herein.

In the preferred method, in FIGS. 6, 7 and 8, yarn ends 50 and 51 are shown placed in clamps 19, 19' and in commingling jet 28 in parallel overlapping alignment, one against the other. Yarn commingling jet 28 receives overlapped yarn ends contained therein. Commingling jet 28 is attached to a compressed air supply such as 80 psi as earlier mentioned. Splicing jet 28 remains rigidly affixed to splicing platform 26, whereas yarn clamps 19, 19' rotate as shown in FIG. 2 relative to splicing platform 26. (No hardware is seen in FIGS. 6, 7 and 8 for clarity and illustrative purposes). With clamps 19 and 19' activated, a pulse of air from commingling jet 28 then mingles yarn ends 50, 51 as shown in FIG. 7. A length of ends of yarn 50, 51 are intermingled along junction 55 of, for example, 12 mm in length. As seen, junction 55 is bulky and has a diameter of approximately twice the diameter of single yarn end 50. With the yarns ends 50 commingled as in FIG. 7, and with clamps 19, 19' (not seen) still engaged, pneumatic cylinder 32, as shown in FIG. 9, activates, extending clamp slide 33 forward as shown in FIG. 2, causing yarn clamps 19, 19' to pivot outwardly, thereby stretching junction 55, effectively reducing the diameter thereof to approximately that of original yarn diameter 47. Clamp arms 37, 37' are attached to respectively, yarn clamps 19, 19', and pivot about axle 38 as shown in FIGS. 1 and 2. Slots 42, 42' in clamp slide 33 receive pins 41, 41' respectively (FIG. 4) whereby upon extension of clamp slide 33, clamp arms 37, 37' pivot accordingly. This pivoting action causes stretching and reducing of junction 55 diameter, creating a much improved yarn splice and allows equipment, such as texturing equipment and the like, to operate more smoothly with less yarn breakage. The stretching of yarn junction 55 approximately doubles the length of junction 55 while reducing the diameter to the approximate original yarn diameter of, for example, yarn 47. After stretching, as seen in FIG. 2, is completed, slide plate 32 returns to its rest position, as cylinder rod 32' retracts and as shown in FIG. 1, clamps 19, 19' release so the spliced yarn can then be lifted from device 10 and new yarn package 52 run continuously as before without stoppage.

In the schematic representation as shown in FIG. 9, yarn splicing device 10 incorporates various preferred pneumatic components. As seen, air from an air compressor (not seen), for example, at 80 psi, passes through supply line 11 into standard manifold 40. Manifold 40, in turn, delivers air through pneumatic line 60 to a conventional, adjustable timer valve 62 which, in turn, delivers air after a short delay (for example, one second) to pneumatic lines 63 and 64. Pneumatic line 64 in turn supplies air to similar adjustable timer valve 65 which supplies air through pneumatic line 66 to pneumatic trigger valve 12 and through pneumatic line 29 to pneumatic cylinder 32 which rotates yarn clamp 19, 19'. Pneumatic conduit 63 supplies air from adjustable timer valve 62 to adjustable timer valve 67, which in turn supplies air through Y-valve 15 to pneumatic cylinders 17, 17' which operate to close clamps 19, 19' respectively through pneumatic line 68. Timer valves 62, 65 and 67 have delays preset to adequately sequence the events as needed.

The illustrations and examples provided herein are for explanatory purposes and are not intended to limit the scope of the appended claims.

I claim:

1. A method of splicing yarn comprising the steps of:

a) overlapping a pair of yarn ends, to create an overlapped section;

b) clamping the yarn at spaced locations proximate said overlapped section;

c) intermingling the yarn ends; and d) longitudinally stretching the intermingled yarn ends to reduce the diameter of the intermingled yarns by about one-half.

2. The method of claim 1 wherein the step of overlapping a pair of yarn ends comprises parallel overlapping of a pair of yarn ends.

3. The method of claim 1 wherein the step of overlapping a pair of yarn ends comprises overlapping a pair of multi-filament yarn ends.

4. The method of claim 1 wherein the step of overlapping a pair of yarn ends comprises overlapping a pair of polymeric yarn ends.

5. The method of claim 1 wherein the step of overlapping a pair of yarn ends comprises overlapping the trailing end of a first yarn package with the leading end of a second yarn package.

6. The method of claim 1 wherein clamping the overlapping yarn ends at spaced locations comprises clamping both yarn ends.

7. The method of claim 6 wherein clamping both yarn ends comprises clamping at two spaced points.

8. The method of claim 1 wherein clamping the overlapping yarn ends comprises pneumatically clamping the overlapping yarn ends.

9. The method of claim 1 wherein intermingling the clamped yarn ends comprises pneumatically intermingling the overlapping yarn ends.

10. The method of claim 9 wherein intermingling the yarn ends pneumatically comprises intermingling polymeric multi-filament yarn ends.

11. The method of claim 1 wherein stretching the intermingled yarn ends comprises stretching the intermingled yarn ends between two clamps.

12. A device for splicing yarn ends comprising:

a) means to commingle the yarn ends; and b) a pair of clamps, said pair of clamps proximate said commingling means, said pair of clamps for clamping the yarn ends and said pair of clamps rotatable in opposite directions relative to one another to stretch the commingled yarn ends.

13. The device of claim 12 wherein said commingling means comprises a pneumatic jet.

14. The device of claim 12 wherein said pair of clamps are spaced apart.

* * * * *